US005232077A

United States Patent [19]

Nichols

[11] Patent Number: 5,232,077

[45] Date of Patent: Aug. 3, 1993

[54] MULTIVEND NEWSPAPER RACK HAVING IMPROVED ACCESS TO INTERIOR

[75] Inventor: David V. Nichols, Springfield, Va.

[73] Assignee: Gannett Co., Inc., Arlington, Va.

[21] Appl. No.: 800,067

[22] Filed: Nov. 29, 1991

[51] Int. Cl.[5] ..... G07F 7/04; G07F 11/02

[52] U.S. Cl. ..... 194/206; 194/350; 221/281

[58] Field of Search ..... 221/155, 281, 286, 287, 221/197; 194/206, 207, 210, 350; 235/379, 381

[56] References Cited

U.S. PATENT DOCUMENTS

| | | | |
|---|---|---|---|
| D. 273,023 | 3/1984 | Chalabian | D20/8 |
| 2,971,675 | 2/1961 | Allegri | 221/124 |
| 3,233,712 | 2/1966 | Witman | 194/207 |
| 3,397,763 | 8/1968 | Wahlberg | 194/206 |
| 3,783,989 | 1/1974 | Jensen | 194/206 |
| 3,826,344 | 7/1974 | Wahlberg | 194/206 |
| 4,011,931 | 3/1977 | Wyckoff | 194/206 |
| 4,473,172 | 9/1984 | Reynolds | 221/213 |
| 4,884,671 | 12/1989 | Gardellini | 194/207 |
| 4,919,250 | 4/1990 | Olson et al. | 221/155 X |

OTHER PUBLICATIONS

"TRC-6700/6700H Coin Changer", installation guide by Mars Electronics International.

"TRC-Combo: The Singular Solution for Single-Price Vending Applications", Mars Electronics International, Dec. 1989.

*Primary Examiner*—F. J. Bartuska

*Attorney, Agent, or Firm*—Burns, Doane, Swecker & Mathis

[57] ABSTRACT

A multivend newspaper vending machine in which substantially the entire contents of the cabinet including its front face are mounted on a base which is movable into and out of the cabinet. This not only facilitates loading, but also permits free access to the money acceptor. This is especially advantageous for servicing the money acceptor.

18 Claims, 2 Drawing Sheets

MULTIVEND NEWSPAPER RACK HAVING IMPROVED ACCESS TO INTERIOR

BACKGROUND OF THE INVENTION

1. Field of the Invention

This invention relates to the field of machines for vending newspapers, and, more particularly, to so-called "multivend" newspaper racks having a door on the front which opens to provide access to all of the newspapers inside.

2. Background Art

The typical newspaper vending machine or "rack" includes a mechanism for validating inserted coins, and, when they amount to the price of a newspaper, for unlatching a door on the front face of the rack. This permits access to all of the newspapers inside the rack. For this reason, these racks are commonly referred to as "multivend" racks.

As is the case with any vending machine, multivend racks require a device which will validate and total the amount of money inserted in the machine. In the past, the types of these devices used in multivend racks have been relatively limited in terms of their capabilities. For example, conventional multivend racks open not only when the coins inserted equal the price of a newspaper, but also when the coins inserted exceed that price. Generally, however, the excess amount is retained and not returned as change. This may discourage potential customers who do not have a combination of coins exactly totalling to the price and so would be forced to pay more.

Besides not being able to give change, conventional racks accept only coins and are not able to accept paper currency. This makes newspapers in the rack unavailable to potential customers who have enough money to buy a newspaper, but not in change.

Also, it may be desirable that racks be provided with the capability of accepting cash alternatives such as credit or debit cards. To accomplish this, it is necessary to provide the rack with a device capable of reading indicia in magnetic media or the like.

To address these concerns, rack money accepting devices which give change, or accept paper currency, or read magnetic media, or any combination of these three, have been proposed and designed. These devices have a greater number of features than those used before so that there is an increased need for access to them for repair, maintenance, and setting. In conventional multivend racks, however, access to the money accepting means is limited and generally must be accomplished by manipulating tools in a narrow space between the mechanism and the side of the cabinet.

SUMMARY OF THE INVENTION

The invention is a multivend newspaper vending machine in which the entire contents of the cabinet including its front face are mounted on a base which is movable into and out of the cabinet. This not only facilitates loading, but also permits free access to the money accepting device. This is especially advantageous for servicing the money accepting device and resetting it as necessary.

More specifically, the invention comprises a multivend newspaper vending machine which includes a cabinet having a top, bottom, back, and sides. A separate element defines a front face. The invention also comprises means, located within the cabinet, for dividing an interior of the cabinet into a first compartment and a second compartment separate from the first compartment. Means for retaining a plurality of newspapers are located in the first compartment behind a door in the front face, and means for accepting money are located within the second compartment behind a panel in the front face. The front face, dividing means, retaining means, and money accepting means are carried by a common base which is movable with respect to the bottom of the cabinet.

BRIEF DESCRIPTION OF THE DRAWINGS

These and other features and advantages of the subject invention will become more fully appreciated from the following written description read in conjunction with the drawings, in which.

DETAILED DESCRIPTION OF THE PREFERRED EMBODIMENTS

Figure 1:
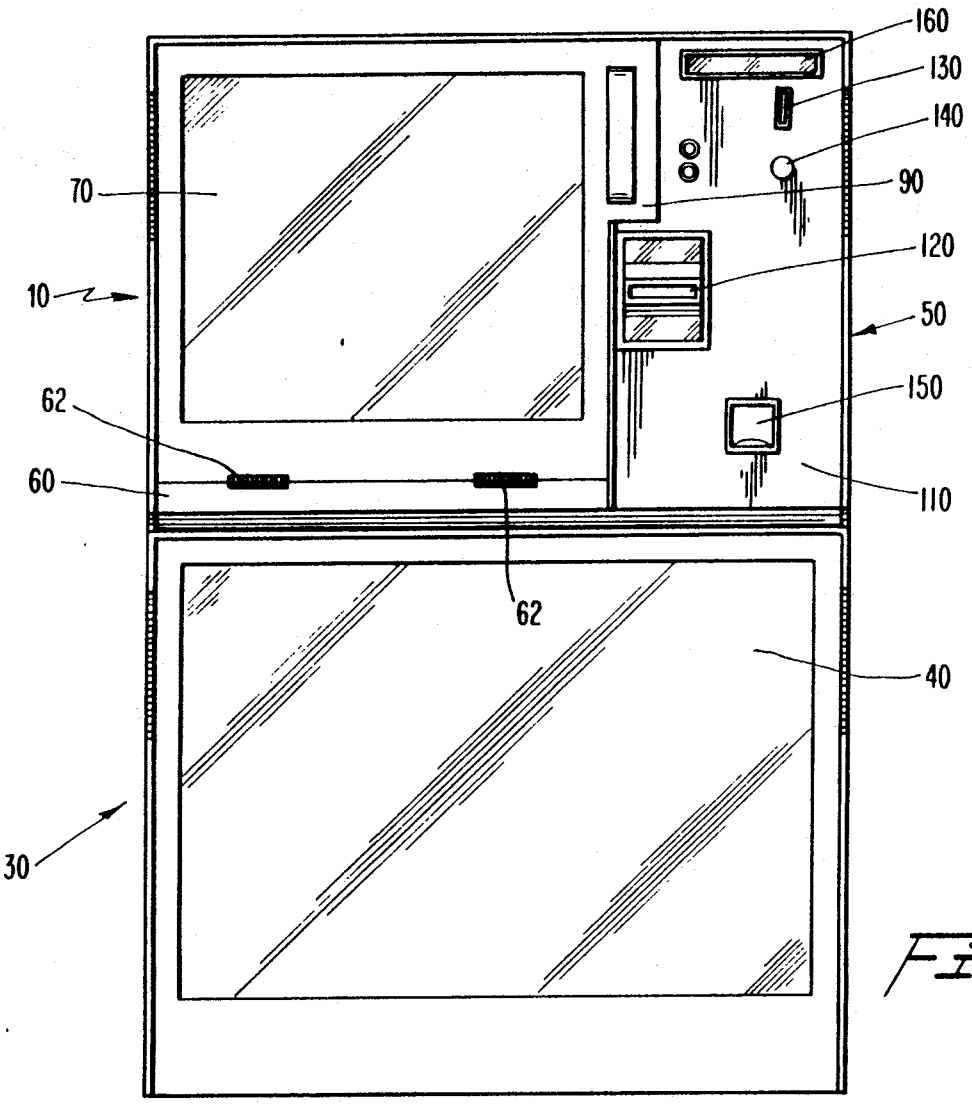
FIG. 1 is a front view of a presently preferred embodiment of a multivend newspaper vending machine according to the present invention.

FIG. 1 shows a newspaper vending machine 10 having a top part 20 and a pedestal 30. The pedestal 30 supports the top part 20 at a level which makes it easy to remove newspapers stored inside. The pedestal 30 may have an area 40 in front for holding, for example, a notice or an advertisement. Alternatively, the pedestal 30 could be a pole-like member supported on a base, or the top part 20 could be placed among a bank of similar top parts 20.

The top part 20 includes a cabinet 50. The top, bottom, rear, and side walls of the cabinet 50 are either integral or joined to make the interior of the cabinet 50 inaccessible except from the front. The height, width, and back-to-front depth of the cabinet 50 conform generally to standard dimensions (e.g., roughly 20"×24"×20"). This enables the cabinet to fit into standard-sized display racks.

The left hand portion of a front face 60 has a door 70 which the purchaser opens to gain access to the newspapers within the cabinet 50. The bottom of the door 70 is attached to the front face 60 by a pair of hinges 62 which are typically spring-loaded to return the door 70 to the closed position in the absence of a counterforce pulling or keeping it open. The back of the door 70 preferable has a display copy holder 80 for holding a copy of the current edition of the newspaper being offered for sale.

The door 70 is held closed by a latch 90 which may be positioned either at the top or side of the door 70. The latch is released under the control of a money acceptor 100 (described below), and automatically retains the door 70 when the door 70 closes until again released by the money acceptor 100.

The right hand portion of the front face 60 has a panel 110 which includes various buttons and slots, described more fully below, by which the purchaser operates the machine. In the embodiment depicted, these include a currency acceptor slot 120, a coin slot 130, a coin return or release push button 140, a coin return 150, and a digital display 160.

Figure 2:
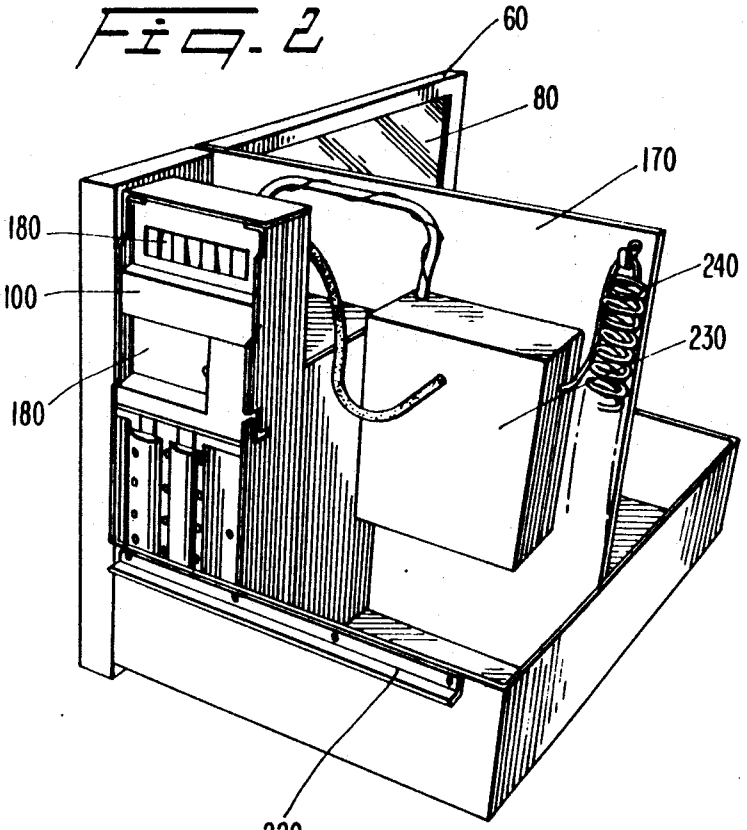
FIG. 2 is a perspective view of internal components of the embodiment of FIG. 1.
Figure 3:
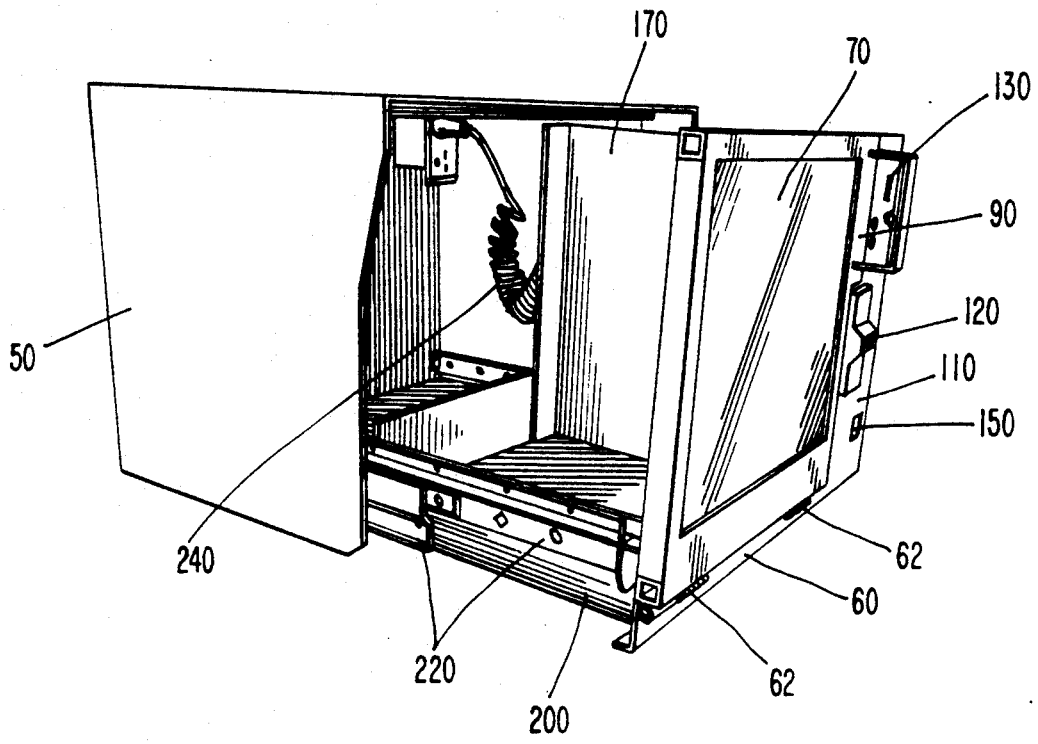
FIG. 3 is perspective view of the embodiment of FIG. 1 with its contents partially pulled out.
Figure 4:
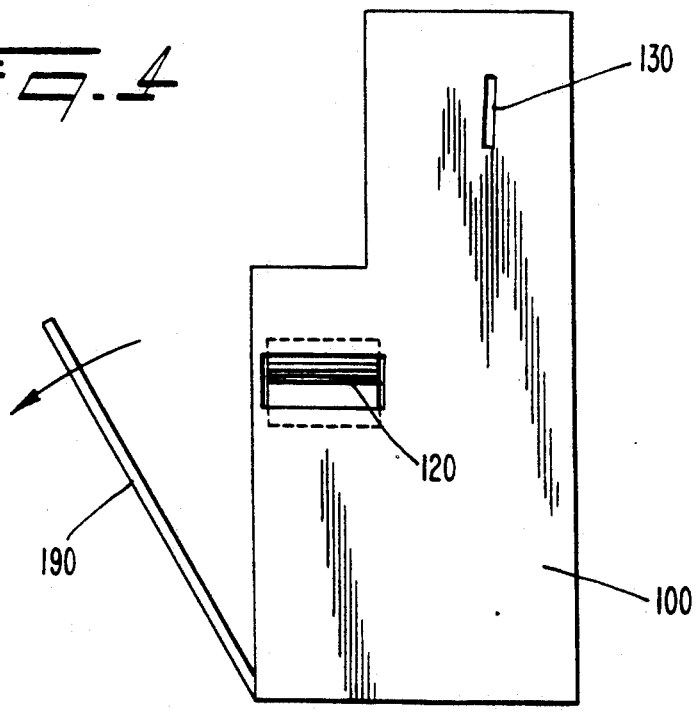
FIG. 4 is a front view of an embodiment of money accepting means according to the present invention.

As can be seen best in FIGS. 2 and 3, within the cabinet 50 there is a vertical internal wall 170 which divides the interior of the cabinet 50 into two essentially separate compartments. The first compartment is that behind the door 70. It is dimensioned to hold standard-sized newspapers (roughly 14"×11.5") and is accessible when the door 70 is open.

The second compartment in the interior of the cabinet 50 is behind the panel 110 on the right hand portion of the front face 60 and contains the money acceptor 100. Although called a "money acceptor" herein for the sake of simplicity, it will be understood that it in fact performs several functions, such as coin testing, currency validation, totalling, and change making.

The money acceptor 100 includes a coin device which receives coins through the coin slot 130. This coin device is preferably one which gives change and operates electrically. It will be appreciated by one having ordinary skill in the art that any one of several commercially available coin devices may be used. In the presently preferred embodiment, the coin device is a model TRC6700H coin device manufactured and sold by Mars Electronics.

The money acceptor 100 also preferably includes a currency validator which receives paper currency through a currency acceptor slot 120. This currency validator is also preferably one which gives change and operates electrically. It will be appreciated by one having ordinary skill in the art that any one of several commercially available devices may be used. In the presently preferred embodiment, the currency validator is a model VFM1 LO U2CS currency validator manufactured and sold by Mars Electronics.

The amount of money validated in the form both of coins and currency is preferably displayed on a digital display 160. This digital display is preferably a three digit, seven-segment LED display of known configuration.

As mentioned above, it may be is desirable to provide the racks with the ability to accept cash alternatives such as credit or debit cards. Toward this end, the rack may be provided slot into which machine readable media may be inserted, as well as a device for reading the medium.

It will be noted by one having ordinary skill in the art that the money acceptor described above, unlike prior coin acceptors for newspaper vending machines, includes components which work electrically. This requires a source of electricity. Machines in locations such as airport terminals and hotel lobbies should have ready access to line power so that the need for electricity should not pose any difficulties. For locations such a street corners, and in general to provide the most flexibility in locating machines, it is preferred to have a money acceptor 100 which can operate on batteries. If power requirements are low enough, batteries could last over the length of a current service interval, or even be solar batteries. The devices from Mars Electronics mentioned above are readily susceptible to modification for operation on battery power and so would be suitable for such an application.

The money acceptor 100 also includes circuitry for coordinating operation of the coin device and currency validator, for driving the display 160, and for determining when a sufficient amount of money has been inserted. It also preferably includes a set of switches 180 which can be used to change settings such as price settings and the like.

One difference between the money acceptor 100 in the present invention and those used in other types of vending machines is that it must be more compact. For example, soft drink vending machines have ample space for containing relatively large devices. In the newspaper vending machine, on the other hand, the overall dimensions are essentially fixed at a much smaller size. This imposes rather stringent size constraints on the smaller interior compartment which does not hold newspapers. This makes it desirable to modify the standard designs for money acceptors.

One such modification which is presently preferred is positioning the initial entry of the coin on the same level as the rest of the mechanism instead of above the rest of the mechanism as in standard designs. While this means that gravity does not assist the passage of the coins through the mechanism quite so well, any attendant degradation of performance is not severe, and is considered more than offset by the savings in vertical dimension.

Another presently preferred modification is in the positioning of the coin release push button 90 with respect to the coin release plate 190. In the presently preferred embodiment, the button has a wedge-shaped end which directly engages the coin release plate 190. This also conserves vertical space.

Once a purchaser inserts enough acceptable coins, currency, or both to amount to the purchase price of a newspaper, the money acceptor 100 produces an electrical signal which in turn actuates a solenoid mechanically coupled to the latch 90, causing it to release the door 70 so that it can be opened.

If the amount of acceptable money exceeds the price of the newspaper, then a change making device incorporated into the money acceptor 100 releases coins amounting to the excess into the coin return 100. Preferably, coins previously accepted to buy newspapers are recirculated in a known manner to the change making device to replenish the store of coins available to make change.

After the latch 90 is released, the purchaser can open the door and withdraw a newspaper. The purchaser then releases the door 70 which shuts to be latched once again. If the amount of coins or currency exceeds the purchase price of the newspaper, then the excess amount is returned as change.

It will be appreciated that the money acceptor 100 included in a newspaper vending machine according to the present invention is more complicated than money acceptors found in prior art devices. This increased complexity brings with it a need for greater access to the money acceptor 100 for maintenance. At the same time, security of the money acceptor 100 should not be compromised. The challenge is thus to make the money acceptor 100 readily accessible to someone servicing the rack, while at the same time keeping it inaccessible from someone who is attempting unauthorized access to the money acceptor 100.

To meet these ends, in the present invention essentially the entire contents of the cabinet 50 are placed on a base 200 (FIGS. 2 and 3) which can be moved into and out of the cabinet 50. The base 200 is locked into the closed position (fully inside the cabinet 50) by a lock 210 which can be opened only by authorized personnel. With the base 200 in the cabinet, customers can gain access to the first compartment, but are blocked from the second compartment by the vertical wall 170.

When someone authorized to service the rack desires to do so, he or she unlocks lock 210. This releases the base 200 so that it is possible to roll it out of the cabinet 50 to a stop position. This provides free access not only to the first compartment for loading newspapers, but also to the second compartment for servicing the money acceptor 100. This servicing can include collecting accumulated money, resetting the purchase price (by, for example, manipulating the switches 180 on the side of the money acceptor 100), replacing batteries, and similar operations.

The base 200 is desirably placed on casters 220 to reduce the effort needed to move it, especially when the rack is loaded with newspapers. These casters may be of any commercially available type so long as they have sufficient strength and durability for use in the rack. They generally comprise two pairs of elongated tracks, one for each side, with one of the tracks being attached to the cabinet 50 and the other to the base 200. Wheels may be interposed between rails of the track to facilitate the sliding of one against the other.

If the unit is being operated by line power, the money acceptor 100 can be attached to a connecting strip 230 which is in turn attached to a pigtail cord 240. The pigtail cord 240 makes it possible to open and close the base 200 without tangling.

The invention has been described above in terms of specific embodiments for the purposes of simplifying the explanation only. It will be apparent to one having ordinary skill in the art that many modifications can be made to these embodiments without departing materially from the teachings of the invention. The invention should therefore not be considered as being limited to those embodiments, but should instead be regarded as being fully commensurate in scope with the following claims.

What is claimed is:

1. A multivend newspaper vending machine comprising:

a cabinet having a top, bottom, back, and sides;

a front face member having a door and panel;

means, located within said cabinet, for dividing an interior of said cabinet into a first compartment behind said door and a second compartment separate and inaccessible from said first compartment and behind said panel;

means, located within said first compartment, for retaining a plurality of newspapers;

means, located within said second compartment, for accepting money;

means located within said second compartment and responsive to said money accepting means, for determining when an accepted amount of money accepted by said money accepting means exceeds a predetermined dollar amount; and means, responsive to said determining means, for enabling customer access to said first compartment by unlatching said door when said determining means determines that said accepted amount exceeds said predetermined dollar amount, said front face member, said interior dividing means, said retaining means, and said money accepting means being mounted on a common base member which is movable with respect to said bottom.

2. A multivend newspaper vending machine as claimed in claim 1 wherein said money accepting means accepts money in the form of coins.

3. A multivend newspaper vending machine as claimed in claim 1 wherein said money accepting means accepts money in the form of paper currency.

4. A multivend newspaper vending machine as claimed in claim 1 wherein said money accepting means accepts money in the form of indicia encoded on machine readable media.

5. A multivend newspaper vending machine as claimed in claim 1, wherein said base is mounted on a slider which in turn is mounted to said bottom of said cabinet.

6. A multivend newspaper vending machine as claimed in claim 1, wherein said base is mounted on a roller assembly which in turn is mounted on said bottom of said cabinet.

7. A multivend newspaper vending machine as claimed in claim 1, further comprising means for preventing said base from moving out of said cabinet past a stop position.

8. A multivend newspaper vending machine as claimed in claim 1, further comprising means for securing said base at a closed position in which said base is contained entirely within said cabinet.

9. A multivend newspaper vending machine comprising:

a cabinet having a top, bottom, and sides;

a base laterally movable with respect to said bottom of said cabinet between a closed position in which said base is substantially entirely within said cabinet and an open position in which said base is extended out from said cabinet;

a front face member mounted on said base, said front face member having a door and a panel;

means, mounted on said base, for dividing an interior of said cabinet into a first compartment behind said door and a second compartment separate and inaccessible from said first compartment, said second compartment being behind said panel when said base is in said closed position, said dividing means comprising a vertical wall;

means, mounted on said base to be in said first compartment when said base is in said closed position, for retaining a plurality of newspapers; and means for accepting money in the form of paper currency, said money accepting means being mounted on said wall to be in said second compartment when said base is in said closed position, and to be inaccessible from said first compartment when said base is in said closed position and freely accessible when said base is in said open position.

10. A multivend newspaper vending machine as claimed in claim 9, wherein said money accepting means operates on live power.

11. A multivend newspaper vending machine as claimed in claim 10, wherein said money accepting means is connected to a receptacle on the back of said cabinet by means of a coiled cord.

12. A multivend newspaper vending machine as claimed in claim 9, wherein said money accepting means includes means for setting a predetermined amount, said predetermined amount setting means being freely accessible when said base is in said open position.

13. A multivend newspaper vending machine as claimed in claim 9, wherein structure defining a coin slot is positioned in said panel laterally forward of and at substantially the same level as the money accepting means.

14. A multivend newspaper vending machine as claimed in claim 9, wherein structure defining a coin release button is positioned in said panel forward of and at substantially the same level as said money accepting means.

15. A multivend newspaper vending machine as claimed in claim 9, further comprising:

means, located within said second compartment and responsive to said money accepting means, for determining when an amount of money accepted by said money accepting means exceeds a predetermined dollar amount;

means, responsive to said determining means, for permitting access to said first compartment when said determining means determines that said accepted amount exceeds said predetermined dollar mount; and means, responsive to said determining means, for dispensing coins in a dollar amount equal to a difference between said accepted amount and said predetermined dollar amount.

16. A multivend newspaper vending machine as claimed in claim 15, wherein said money accepting means replenishes a supply of coins for said coin dispensing means.

17. A multivend newspaper vending machine as claimed in claim 15, further comprising a display in said panel for indicating at least one of said predetermined amount, said accepted amount, or said difference.

18. A multivend newspaper vending machine comprising:

a standard-sized cabinet comprising a bottom wall, a top wall, a back wall, and both side walls;

a base coupled to said cabinet to be movable into said cabinet to a closed position in which said base is substantially entirely within said cabinet and out of said cabinet to an open position in which said base is substantially extended out of said cabinet;

front face means carried by said base which defines a front face of said cabinet when said base is in said closed position, said front face means having a door and a panel;

a vertical wall carried by said base for dividing an interior of said cabinet into a first compartment behind said door for retaining standard-sized newspapers and a second compartment behind said panel and separated and inaccessible from said first compartment;

means, mounted on said vertical wall and located in said second compartment, for accepting money in the form of paper currency and coins;

a coin slot located in said panel in a position in front of and on substantially the same level as said money accepting means for introducing coins into said money accepting means;

a coin release button protruding through said panel at a position in front of and not above said money accepting means and mechanically engaging said money accepting means for releasing coins from said money accepting means; and a coiled cord extending from said money accepting means to a receptacle on said back wall of said cabinet.

* * * * *